United States Patent [19]

Green et al.

[11] Patent Number: 5,025,607

[45] Date of Patent: Jun. 25, 1991

[54] APPARATUS TO AID IN THE INSTALLATION OF DOORS

[76] Inventors: William A. D. Green, 93 Cary Street, Leichhardt, New South Wales 2040, Australia; David N. Tregarthen, 6/37 Birriga Road, Bellevue Hill, New South Wales 2023, Australia

[21] Appl. No.: 390,160

[22] Filed: Aug. 7, 1989

[30] Foreign Application Priority Data

Aug. 5, 1988 [AU] Australia ..... PI9722

[51] Int. Cl.[5] ..... E04G 21/00; F16M 13/00

[52] U.S. Cl. ..... 52/749; 52/127.2; 248/351; 248/257; 269/904; 269/905

[58] Field of Search ..... 52/749, 127.2; 248/351, 248/357; 269/904, 905

[56] References Cited

U.S. PATENT DOCUMENTS

| | | | |
|---|---|---|---|
| 2,914,812 | 12/1959 | Christian | 52/127.2 |
| 2,914,813 | 12/1959 | Christian | 52/127.2 |
| 2,914,814 | 12/1959 | Christian | 52/127.2 |
| 3,027,686 | 4/1962 | Dates | 52/127.2 |
| 4,304,078 | 12/1981 | Meriwether | 52/127.2 |

*Primary Examiner*—John E. Murtagh
*Assistant Examiner*—Deborah McGann Ripley
*Attorney, Agent, or Firm*—Ladas & Parry

[57] ABSTRACT

A pair of supports to aid in the installation of door jambs, each support includes a base to rest upon and to be secured to a support surface. Extending upwardly from the base is a brace member which has at its upper end a securing bracket to engage the door jamb. Adjacent the base is a second securing bracket which also engages the door jamb. Both brackets are adjustable movable horizontally to adjust the door jamb engaged thereby.

4 Claims, 3 Drawing Sheets

APPARATUS TO AID IN THE INSTALLATION OF DOORS

The present invention relates to an apparatus to aid in the installation of door jambs.

The installation of door jambs, both in new buildings and by way of replacement of old door jambs to meet fire resistant ratings, is generally time consuming and can take up to two hours per door.

In the construction of new buildings, particularly brick buildings, a door jamb is frequently supported by timber braces which are pinned or otherwise secured to a concrete floor. This known method of supporting a door jamb during construction is again very time consuming and therefore expensive. A still further disadvantage, is that material, namely timber, is required and often is not reusable.

It is the object of the present invention to overcome or substantially ameliorate the above disadvantages.

There is disclosed herein a support to aid in the installation of door jambs, said support comprising:

- a base to rest upon and to be secured to a floor surface;
- a brace member attached to, and extending upwardly from, said base;
- a first securing bracket attached to an upper portion of said brace member and adapted to engage a door jamb; and
- a second securing bracket attached to said base or a lower portion of said brace member and adapted to also engage the door jamb so that the brackets co-operate to retain the door jamb in a generally vertical orientation.

There is further disclosed herein a bracket to aid in the securing of a door jamb within a door opening of a wall, said door jamb having a pair of vertical members and a top member, with the vertical members being formed from metal channel of generally "C-shaped" transverse cross section so as to have a pair of opposing longitudinally extending flanges; said bracket comprising,

- a body portion to extend between and to engage the pair of opposing flanges, said body portion having a pair of passages; and
- a threaded member threadably engaged in each passage and co-operating therewith to move in a direction toward a wall surface defining said door opening so as to engage the wall surface so that rotation of each threaded member adjusts the position of the associated vertical member.

A preferred form of the present invention will now be described by way of example with reference to the accompanying drawings, wherein.

Figure 1:
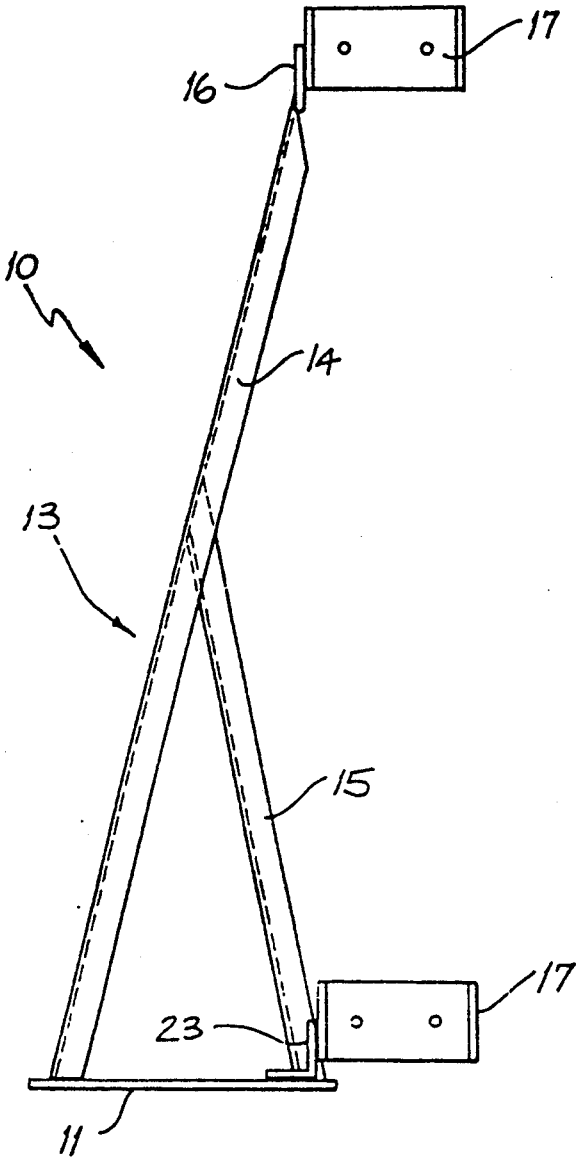
FIG. 1 is a schematic side elevation of a support to aid in the installation of door jambs.
Figure 2:
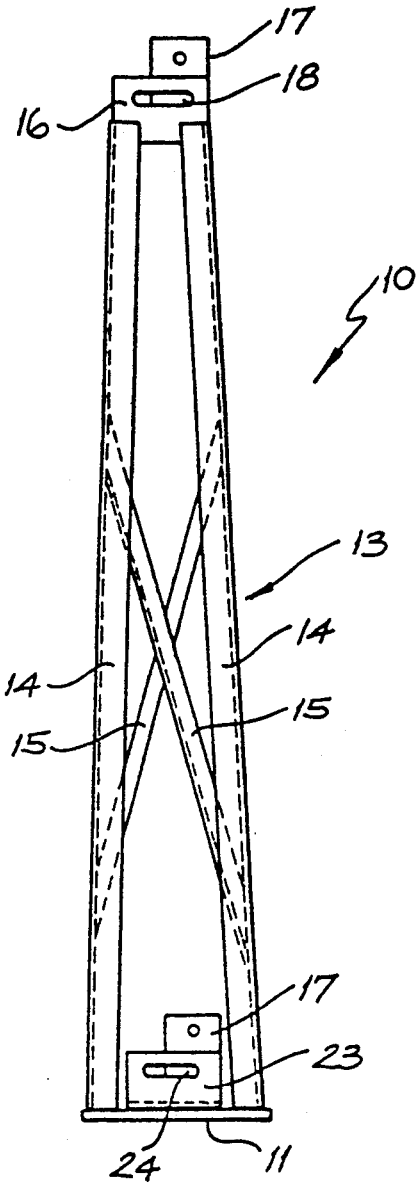
FIG. 2 is a schematic front elevation of the support of FIG. 1.
Figure 3:
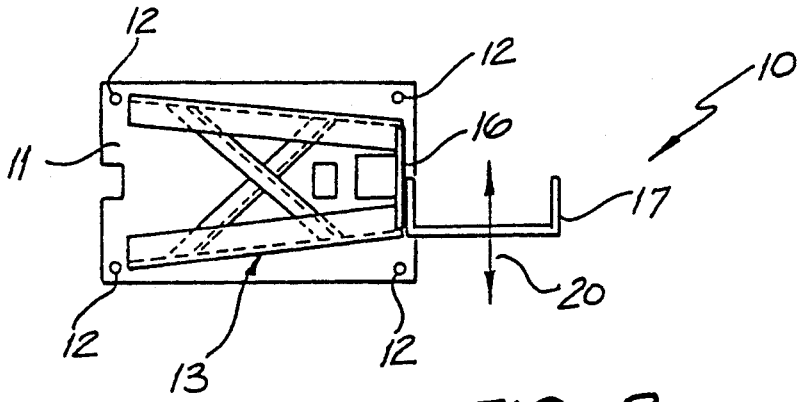
FIG. 3 is a top plan view of the support of FIG. 1.
Figure 4:
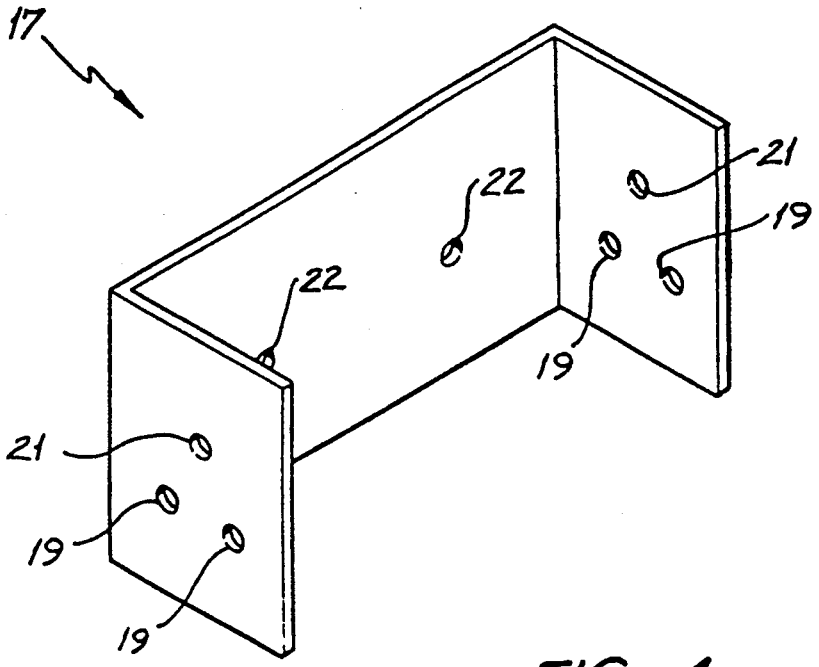
FIG. 4 is a schematic perspective view of a bracket employed in the support of FIG. 1.
Figure 5:
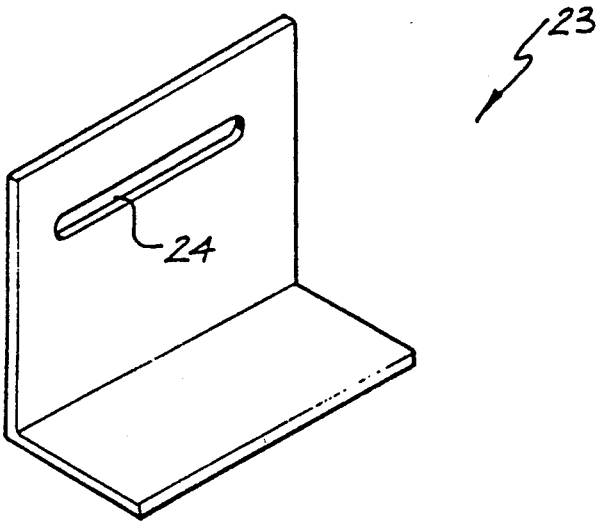
FIG. 5 is a schematic perspective view of a mounting plate for the bracket of FIG. 4.

In FIGS. 1 to 5 of the accompanying drawings, there is schematically depicted a support 10 to aid in the installation of door jambs, and preferably door jambs having vertical members and a top member formed from metal channel of "C-shaped" transverse cross section.

In use, two of the supports 10 would be used with each door jamb, with one support 10 being operatively associated with one of the vertical members of the door jamb. The support 10 includes a base 11 which would preferably be secured to a floor surface by fasteners of some sort. Alternatively, weights may be provided and stacked on the base 11 to secure the support 10 in position. For example, the base 11 may have one or more passages 12 through which the fasteners may pass to engage the floor surface.

Fixed to, and extending upwardly from the base 11 is a brace member 13 consisting of a pair of posts 14 and a pair of braces 15. The posts 14 terminate at their upper end with a mounting plate 16 which adjustably engages a bracket 17. The mounting plate 16 is provided with a generally horizontally extending slot 18 through which a pair of threaded fasteners pass. The threaded fasteners also pass through holes 19 in the bracket 17. Accordingly, the bracket 17 can be adjusted in the direction of the arrow 20 to enable correct positioning of the door jamb.

The bracket 17 is also provided with a pair of opposing passages 21 through which threaded fasteners pass to engage the door jamb. Again, the fasteners enable adjustment of the position of the door jamb. Still further, passages 22 are provided, through which threaded fasteners pass to again engage the door jamb and allow adjustment thereof in respect of position. These fasteners also inhibit twisting of the jamb.

Fixed to the base plate 11, is a mounting plate 23 which has a slot 24 and performs the same basic functions as the mounting plate 16. Secured to the mounting plate 23 is a further one of the brackets 17. Again a pair of fasteners secure the bracket 17 to the mounting plate 23 via the slot 24. The bracket 17 secured to the mounting plate 23 is adjustable in the same manner as the bracket 17 associated with the mounting plate 16.

Figure 6:
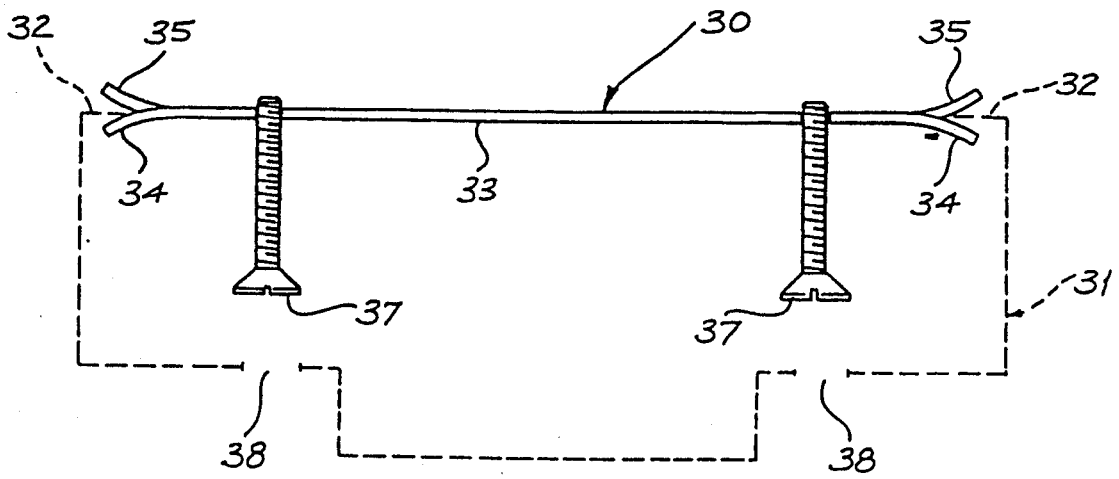
FIG. 6 is a schematic top plan view of a bracket to aid in the securing of door jambs within a door opening of an existing wall.
Figure 7:
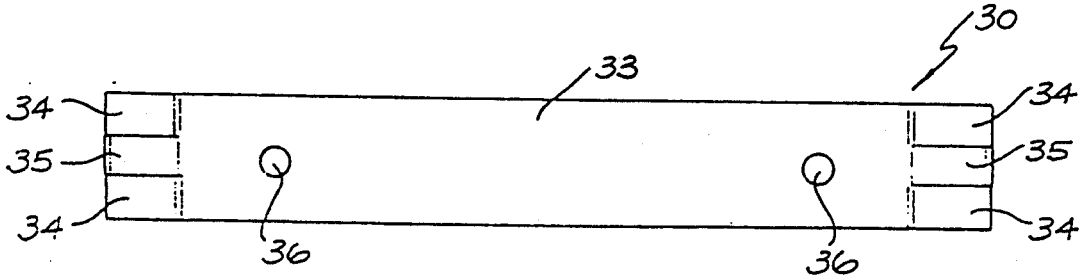
FIG. 7 is a schematic plan view of the bracket of FIG. 1.
Figure 8:
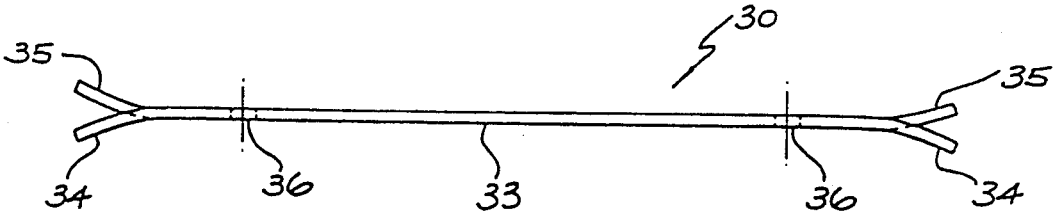
FIG. 8 is a schematic end elevation of the bracket of FIG. 8.

In FIGS. 6 to 8 of the accompanying drawings, there is schematically depicted a bracket 30 to aid in fixing a door jamb within a door opening in a wall. The bracket 30 is adapted to be used with a door jamb consisting of a pair of vertical members and a top member. The vertical members would preferably be formed of metal channel of a generally "C-shaped" configuration. In the accompanying drawings the vertical member 31 is a metal channel having a pair of opposing flanges 32. Extending between the flanges 32 is one or more of the brackets 30.

The bracket 30 includes a generally planar body 33 formed from stripped metal. Each end of the body 33 is punched so as to have co-operating lugs 34 and 35 which engage the flanges 32 to secure the bracket 30 in position.

The body 30 is provided with a pair of passages 36 through which threaded fasteners 37 pass, which fasteners are movable in a direction generally normal to the surfaces of the wall door opening. The member 31 is provided with a pair of apertures 38 through which a screwdriver may pass to engage the threaded fasteners 37.

In use of the above described bracket 30, the member 31 is secured to the wall by suitable threaded fasteners. Thereafter, the fasteners 37 are adjusted to engage the wall opening and move the member 31 to its correct position and orientation.

The claims defining the invention are as follows:

1. A support to aid in the installation of door jambs, said support comprising:

a base to rest upon and to be secured to a floor surface;

a brace member attached to, and extending upwardly from said base, said brace member having an upper portion and a lower portion;

a first securing bracket to be fixed to a door jamb, and connected to a first mounting plate located on said upper portion of said brace member;

a second securing bracket also to be fixed to the door jamb, and connected to a second mounting plate located on said lower portion of said brace member, adjacent said base;

said first and second brackets cooperating to retain the door jamb in a generally vertical orientation, and being adjustably connected to said brace member for movement in a plurality of predetermined directions relative thereto, which predetermined directions are horizontal, parallel, co-planar and normal to the plane of the door jamb, and each bracket includes means enabling adjustment of the door jamb in the plane of the door.

2. The support of claim 1, wherein each bracket is generally U-shaped so as to have a base portion attached to its respective mounting plate, and a pair of co-extensive parallel legs between which the door jamb is attached.

3. The support of claim 2, wherein the adjustment means are threaded fasteners engaging said legs and adjustable to engage the door jamb.

4. A support to aid in the installation of door jambs, said support comprising:

a base to rest upon and to be secured to a floor surface;

a brace member attached to, and extending upwardly from, said base, said base member having an upper portion and a lower portion;

a first securing bracket to be fixed to a door jamb and connected to a first mounting plate located on said upper portion of said brace member; and a second securing bracket also to be fixed to the door jamb and connected to a second mounting plate located on said lower portion of said brace member adjacent said base, said first and second brackets cooperating to retain the door jamb in a generally vertical orientation, and wherein said brackets are adjustably connected to said brace member, for movement in a plurality of predetermined directions relative to said brace, which predetermined directions are horizontal, parallel, co-planar and normal to the place of the door jamb, and each bracket has adjustment means for adjustment of the door jamb in the plane of the door which includes a pair of threaded fasteners which engage the door jamb at spaced positions which are in the horizontal plane.

* * * * *